United States Patent [19]

Shaw

[11] Patent Number: 4,531,686

[45] Date of Patent: Jul. 30, 1985

[54] PORTABLE EQUIPMENT HOIST

[76] Inventor: Terrance L. Shaw, 1026 Henrickson, Clawson, Mich. 48017

[21] Appl. No.: 532,542

[22] Filed: Sep. 14, 1983

[51] Int. Cl.[3] ..... B65H 75/40

[52] U.S. Cl. ..... 242/96

[58] Field of Search ..... 242/96, 100.1, 86.1; 224/269

[56] References Cited

U.S. PATENT DOCUMENTS

| | | | |
|---|---|---|---|
| 1,182,124 | 5/1916 | Westbrook | 242/96 |
| 1,663,766 | 3/1928 | Landis | 242/96 |
| 1,950,745 | 3/1934 | Patterson | 242/96 |
| 1,990,135 | 2/1935 | Sato | 242/96 |
| 2,470,250 | 5/1949 | Kienle | 242/96 |
| 2,615,649 | 10/1952 | Flewelling | 242/96 |
| 2,717,129 | 9/1955 | McDonald | 242/96 |
| 2,873,929 | 2/1959 | Meyer et al. | 242/85.1 |
| 2,918,049 | 12/1959 | Stockfleth | 242/85.1 |
| 2,938,514 | 5/1960 | Berg | 242/85.1 |
| 2,982,491 | 5/1961 | Beiderwell | 242/96 |
| 3,086,723 | 4/1963 | Meeks | 242/96 |
| 3,100,608 | 8/1963 | Goldfarb | 242/96 |
| 3,134,556 | 5/1964 | Wasson | 242/96 |
| 3,313,498 | 4/1967 | Wasson | 242/96 |
| 3,589,634 | 6/1971 | Mason | 242/96 |
| 3,637,158 | 1/1972 | Jacobsen | 242/96 |
| 3,983,977 | 10/1976 | Crabb | 242/96 X |
| 4,024,667 | 5/1977 | Wegener | 242/85.1 |
| 4,061,290 | 12/1977 | Harrill | 242/96 |
| 4,088,276 | 5/1978 | Littleton | 242/96 |
| 4,195,794 | 4/1980 | Ricci et al. | 242/96 |
| 4,200,249 | 4/1980 | Synstelien et al. | 242/96 |
| 4,244,536 | 1/1981 | Harrill | 242/96 |
| 4,282,954 | 8/1981 | Hill | 242/96 X |
| 4,390,142 | 6/1983 | Cheng | 242/96 |

*Primary Examiner*—Stephen Marcus
*Assistant Examiner*—Leo J. Peters
*Attorney, Agent, or Firm*—Harness, Dickey & Pierce

[57] ABSTRACT

A portable reel-type hoist comprising an annular housing forming an opensided annular cavity, having a spindle member associated therewith and a spool or reel assembly positioned within said housing and rotationally engaging said spindle member.

1 Claim, 2 Drawing Figures

10
12
14
16
17
18
20
22
24
26
28
30
34
36
37
38
40
42
44
46
48
50
52
54
56
57
58
60
62
64
66
67
68
70
72
74
76
77
78
80
82
84
86
87
88
90
92
94
96
98
100
102
104
106
108
110

PORTABLE EQUIPMENT HOIST

BACKGROUND AND SUMMARY OF THE INVENTION

This invention relates generally to hoists, and more particularly to portable reel devices. Although primarily designed for aiding hunters raise equipment to elevated heights, it is to be understood that the present invention has many other applications for sportsmen, hobbyists and others in and around the house.

Hunters in general, and archery or bow hunters in particular, frequently take positions on elevated blinds in trees. In addition, hunting in a particular terrain may require climbing. Trying to negotiate to a higher position while holding equipment is awkward as well as dangerous. Equipment positioned across or on the body tends to become entangled on branches or the like interfering with climbing action.

Similarly, maintenance and other activities in and around the home frequently require climbing while holding tools, such as saws, cans of paint, or the like. Such activities are, of course, dangerous as both hands are not available for use in climbing.

The present invention is intended to obviate many such problems by providing a convenient means of hoisting, or raising relatively small and portable items such as hunting equipment, tools, etc. to an elevated position, thereby allowing both hands to be used for climbing without the need to position such items or equipment across or on the body.

Accordingly, a principal object of the present invention is to provide a new and improved device which is itself highly portable for hoisting items of the aforesaid character to an elevated position.

Another object of the present invention is to provide a reel-type hoist that may conveniently be attached to an operator's belt allowing both hands free for climbing.

Still another object of the present invention is to provide a reel-type hoist having relatively free and easy movement while rugged in construction permitting extended operational use under harsh environmental conditions as are commonly encountered by sportsmen when hunting and the like.

A further object of the present invention is to provide a reel-type hoist that is manufactured of molded plastic parts.

Another object of the present invention is to provide a reel-type hoist that is easy to assemble.

A still further object of the present invention is to provide a reel-type hoist that is economical to manufacture.

Other objects, features and advantages of the present invention will become apparent from the subsequent description and the appended claims.

DESCRIPTION OF THE PREFERRED EMBODIMENTS

Figures 1, 2:
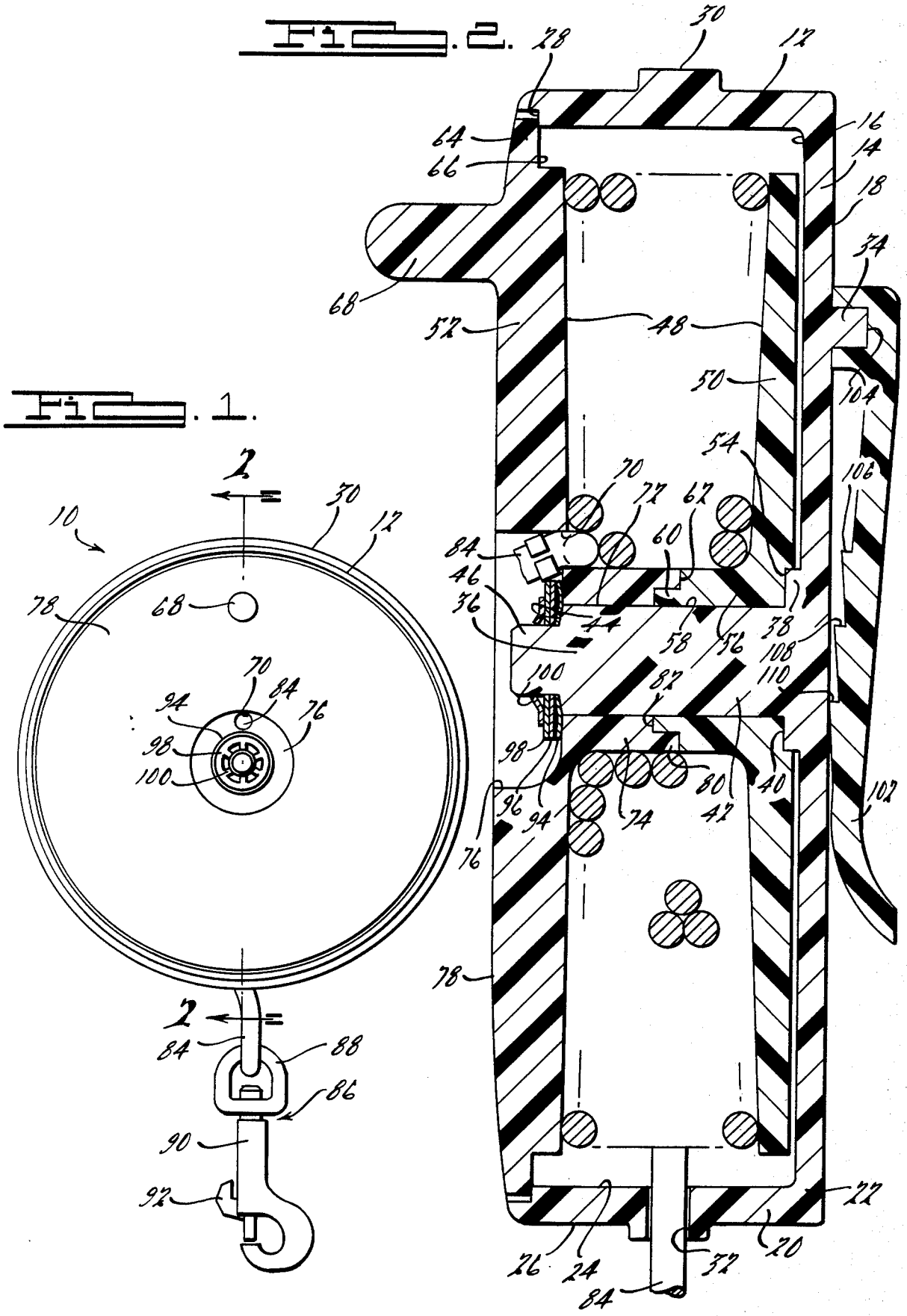
FIG. 1 is a front elevation view of the portable equipment hoist of the present invention.
FIG. 2 is a transverse cross-sectional view taken substantially along line 2—2 of FIG. 1.

Referring now to the drawings, and in particular to FIG. 2, one embodiment of the present invention is disclosed. Portable reel-type hoist apparatus 10 may be of any suitable material and generally includes a housing; a spindle; and a spool or reel assembly.

Although housing 12 may be constructed of any suitable material, preferably it is a one-piece monolithic structure of molded polymeric material. Generally, housing 12 is annular in shape forming an open sided annular cavity. Housing 12 includes circular side section 14, defining an inner surface 16 and an outer surface 18; an annular sidewall 20 formed integral with the periphery of side section 14 as seen at 22. Annular side wall 20 defines inner surface 24 and outer surface 26, and includes annular housing shoulder 28; and ridge 30, which is integral with outer surface 26 of annular sidewall 20. Annular sidewall 20 also includes line port 32 which preferably should be slightly larger in diameter than whatever line material is being used. This permits any moisture which may accumulate within reel-hoist 10 to drain out while not restricting line reeling movement during operation.

Rearward surface 18 of housing 12 also includes belt clip nub 34 which is generally rectangular in structure and extends away from and generally perpendicular to rearward surface 18.

Spindle member 36 may be constructed of any suitable material and preferably is of a molded polymeric material. In the preferred embodiment, spindle member 36 is formed integral with housing 12. However, it should be understood that spindle member 36 and housing 12 could be manufactured separately, and assembled without departing from the subject matter coming within the scope of this disclosure. Spindle member 36 generally includes circular spindle base 38, spindle base surface 40, spindle body 42, spindle shoulder 44 and spindle hub 46.

Spindle member 36 is positioned generally centrally within said annular cavity formed by housing 12 and extends outwardly from inner surface 26 substantially in the same direction as annular side wall 20 of housing 12. When spindle member 36 and housing 12 are formed as separate components, spindle member 36 is fixedly secured in position. This may be accomplished by a variety of means such as adhesives, epoxies, welding, or mechanical type fasteners.

Spindle body 42 defines an annular surface over which first and second side elements 50 and 52 of a spool or reel assembly 48 may rotate.

Spindle hub 46 defines an annular surface over which reel assembly retaining means are mounted, said retaining means abuttingly engage annular spindle shoulder 44, without interfering with rotational movement of said reel assembly 48 around said spindle body 42.

Spool or reel assembly 48 is generally composed of first side element 50 and second side element 52. Reel assembly 48 may be constructed of any suitable material and preferably is of molded polymeric material. First side element 50 is generally annular in shape and includes circular spindle base receiving recess 54; annular spindle receiving section 56; axial bore 58; first side element annular tongue 60; and first side element annular channel 62. Spindle base receiving recess 54 of first side element 50 rotationally engages spindle member 36 at spindle base surface 40 and overlaps a portion of the top of spindle base 38. First side element 50 further rotationally engages spindle member 36 along the length of axial bore 58 of spindle receiving section 56.

Second side element 52 is generally annular in shape and includes outer peripheral edge 64; annular recess 66; handle 68; line securing port 70; axial bore 72; annular spindle receiving section 74; and spindle hub recess 76. Second side element 52 rotationally engages housing 12 at outer peripheral edge 64 and annular housing shoulder 28. A tight tolerance is maintained between outer peripheral edge 64 and housing shoulder 28 by means of reel assembly retaining means which will be described later. By maintaining a tight tolerance, dirt or other extraneous matter is substantially precluded from entering said housing cavity. Handle 68 is generally annular in shape and extends from exterior surface 78 of second side element 52 in the same general direction as annular side wall 20 of housing 12. Handle 68 facilitates manual gripping by an operator during use of the present invention. Second side element 52 also includes line securing port 70 through which one end of line 84 may be passed. A staple or other suitable device is secured to this end of line 84 to prevent its passage back through line securing port 70 and into the housing cavity. Second side element 52 rotationally engages spindle member 36 at spindle body 42 and along the length of axial bore 72, of spindle receiving section 74.

In the preferred embodiment, first side element 50 and second side element 52 mutually engage each other through a tongue and channel arrangement. Second side element tongue 80 overlaps and engages first side element annular channel 62. First side element annular tongue 60 engages second side element annular channel 82 underneath second side element annular tongue 80. First side element 50 and second side element 52 are secured to each other at the tongue and channel overlap through sonic weld, adhesives, epoxies, or the like. When mutually engaged, first and second side elements 50 and 52 define an annular line winding area or reel core over which line 84 is positioned.

It is contemplated that first and second side elelments 50 and 52 may be modified to mutually engage each other by alternative means, such as intermeshing teeth.

Line 84 is fed through line port 32 of housing 12 and through eye 88 of swivel eye bolt snap 86 forming a loop and secured to itself by means of a staple or other suitable securing means. In the preferred embodiment, line 84 is nylon rope, but may be of any suitable rope, wire, cable or the like. It should be appreciated a number of alternative devices to swivel eye bolt snap 86 may be used. It is further contemplated that line 84 may not have any device secured to it, thus permitting an operator to tie the free end of line 84 to equipment or the like, although it is contemplated a staple or other suitable device would be attached to line 84 such that it could not be reeled into housing 12 during use of the present invention.

First side element 50 and second side element 52 are mounted on spindle member 36 and retained in their operational position within the annular cavity formed by housing 12 by means of frictional engagement of spring washer 94, spacer washers 96 and 98 and retaining ring 100 which circumferentially engage spindle hub 46 and seat against spindle shoulder 44.

It is further contemplated alternative retaining means may be employed for mounting first and second side elements 50 and 52 in their operational position within the cavity formed by housing 12 and circumferentially engaging spindle member 36. Such alternative retaining means include cutting threads on spindle hub 46 and positioning a nut on said spindle hub 46. It is further contemplated a hole may be placed generally through the center of spindle hub 46 and a cotter pin positioned through said hole.

The present invention also includes belt clip 102 formed of resilient molded plastic, preferably, and includes clip nub recess 104 and belt steps 106, 108 and 110. Belt clip 102 is secured to housing 12 at belt clip nub 34 by clip nub recess 104. Belt clip nub 34 seats within clip nub recess 104 and is secured by means of sonic welding, adhesives, epoxy, or the like. Belt steps 106, 108 and 110 are provided so belt clip 102 may accommodate variety of different width belts and provide a relatively secure attachment of the present invention to an operator's belt.

It will be appreciated that the present invention is susceptible to modification, variation and change without departing from the proper scope or fair meaning of the accompanying claims.

I claim:

1. A hoist device for use by bow hunters and the like adapted to be manufactured by molding processes from a polymeric plastic material comprising:

an annular housing member having a back wall section and a peripheral side wall section extending at a generally right angle to and integrally connected to said back wall section;

said wall sections forming an opensided annular cavity, said wall sections further forming an annular groove;

a spindle member integrally connected to said back wall section, said spindle member arranged generally centrally of said cavity and extending outwardly from said back wall section of said housing member in substantially the same direction as said side wall section;

a reel assembly rotationally disposed within said cavity and supported for rotational movement therewithin upon said spindle member;

said reel assembly comprising first and second reel side elements arranged in face to face relationship defining an annular line winding area therebetween; each of said reel side elements also comprising an annular spindle receiving section having an axial bore through which said spindle member extends, said spindle receiving sections of said reel side elements extending axially and having complementary shaped surfaces providing interfitting assembly of said reel assembly;

one of said reel side elements having an outer peripheral edge portion disposed within said annular groove and in close proximate relation to the outermost portion of said side wall section of said housing member so as to substantially enclose said cavity;

a washer which frictionally engages said spindle member thereby preventing axial disassembly of said reel assembly from said spindle member;

a line extending through one of said side elements having means secured at one end thereof for preventing disassembly of said line from said side element;

an opening in said side wall of said housing through which said line extends;

a belt clip secured to a rearward surface of said housing back section; and a handle member extending outwardly from and substantially perpendicular to an exterior side of one of said reel side elements and formed integrally therefrom.

* * * * *